US005545093A

United States Patent [19]

Contestabile et al.

[11] Patent Number: 5,545,093

[45] Date of Patent: Aug. 13, 1996

[54] BILLIARD ACCESSORY

[76] Inventors: Kevin D. Contestabile, 99 Barcrest Dr., Rochester, N.Y. 14616; Richard A. Jackson, 4122 Canal Rd., Spencerport, N.Y. 14559

[21] Appl. No.: 299,577

[22] Filed: Sep. 1, 1994

[51] Int. Cl.[6] ..... A63D 15/00

[52] U.S. Cl. ..... 473/36

[58] Field of Search ..... 473/35, 36, 37, 473/38, 39

[56] References Cited

U.S. PATENT DOCUMENTS

| | | | |
|---|---|---|---|
| 561,659 | 6/1896 | Currier | 473/36 |
| 848,835 | 4/1907 | Leroy . | |
| 948,114 | 2/1910 | Morrison . | |
| 965,444 | 7/1910 | Dahl . | |
| 1,334,724 | 3/1920 | Tyler | 473/36 |
| 1,514,391 | 11/1924 | Moses et al. . | |
| 2,628,096 | 2/1953 | Bell . | |
| 3,468,535 | 9/1969 | Obst . | |
| 3,728,828 | 4/1973 | Freedman . | |
| 3,843,120 | 10/1974 | Ricci | 473/36 |
| 3,847,110 | 11/1974 | Inoue | 273/32 R |
| 3,963,237 | 6/1976 | Bushberger | 473/36 |
| 4,785,586 | 11/1988 | Kratfel . | |
| 4,953,770 | 9/1990 | Bond, Sr. . | |
| 5,104,122 | 4/1992 | Gossman . | |
| 5,129,187 | 7/1992 | Cain | 473/35 |

*Primary Examiner*—Theatrice Brown
*Attorney, Agent, or Firm*—Cumpston & Shaw

[57] ABSTRACT

A compact billiard accessory has a generally cylindrical first and second housing which are selectively connectable. The first housing includes a first concave, abrasive surface located adjacent to a first annular end surface of the housing for scraping a cue stick tip, and a second concave, abrasive surface located adjacent to an opposed annular end surface of the housing for shaping the tip. The first housing has scoring marks on its surface and includes two rotatable scoring wheels for tallying game scores. The second housing has a cap with a hole in its surface at one end of the housing that can be rotated to align the hole with a hole in the second end surface of the housing for forming a channel to a refillable talc chamber in the housing. A cue chalk holder fits in the first end of the second housing. When not in use, the first and second housings can be connected to form a compact billiard accessory for clean and convenient storage.

19 Claims, 3 Drawing Sheets

FIG. 3
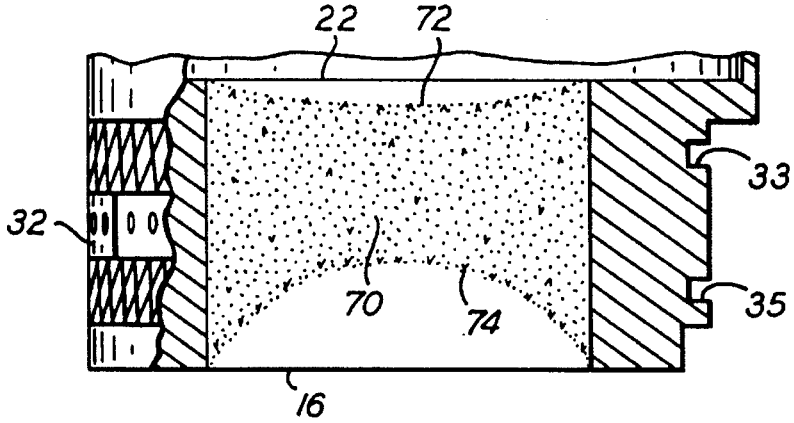
FIG. 4
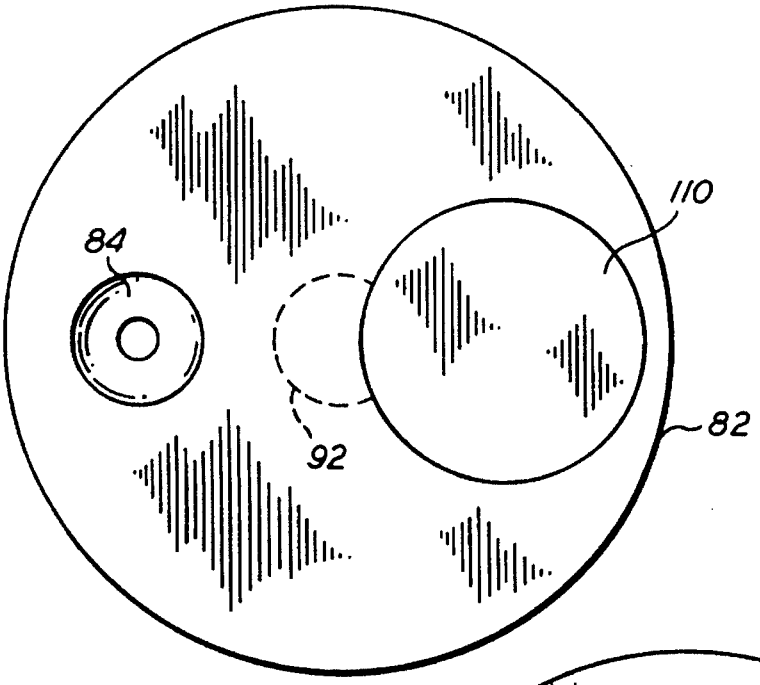
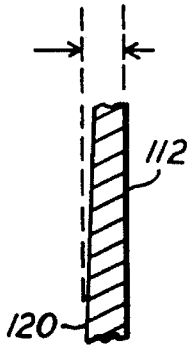
FIG. 8
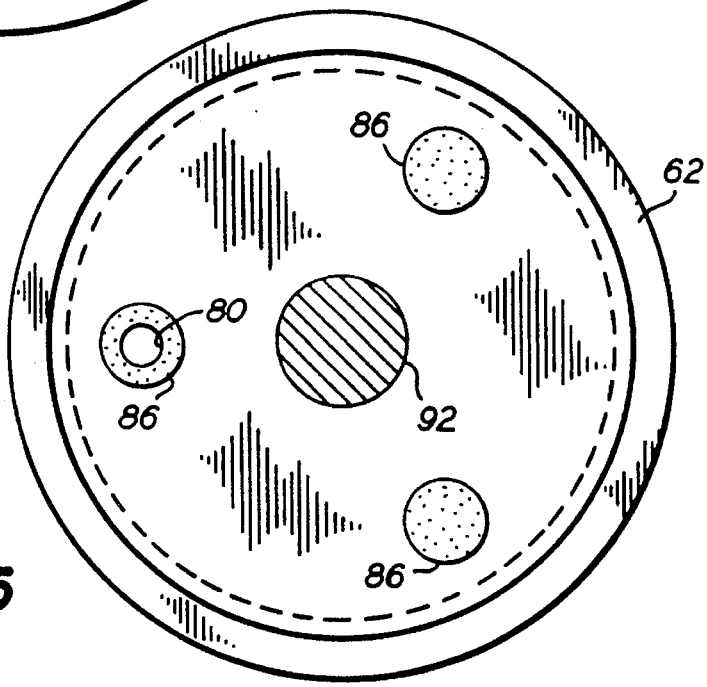
FIG. 5

BILLIARD ACCESSORY

BACKGROUND OF THE INVENTION

1. Field of the Invention

This invention relates to a billiard accessory and in particular to a device capable of five functions relating to score keeping, cue stick tip conditioning and talc dispensing.

2. Description of the Related Art

Billiards and related games played with a cue stick have been around for a long time. Accordingly, many devices have been invented that are intended to complement the game itself or equipment associated therewith.

Currier, U.S. Pat. No. 561,659, describes a billiard chalk holder comprising a receptacle which holds a cue chalk. The receptacle has a circular mouth for the reception of the end of the cue, and is provided with a felt, or equivalent wiper which removes excess chalk adhering to the side of the cue. The chalk holder also includes a second threaded body portion attached to the chalk holding portion for holding a piece of sandpaper for working the tip of the cue stick.

Dahl, U.S. Pat. No. 965,444, shows a portable chalk holder allowing access to the chalk at one end, the other end holding a roughening element for roughening the tips of billiard cues.

Freedman, U.S. Pat. No. 3,728,828 describes a cue tip trimmer including a cylindrical recess and a concave recess formed directly behind the cylindrical recess, both recesses having abrading surfaces for grinding off cue tip material in excess of the ferrule diameter and roughening the tip.

Bushberger, U.S. Pat. No. 3,963,237, shows a generally cylindrical device that has a chalk holder at one end, and a talc dispenser at the other end. The chalk holder has a motor driven oscillating mechanism for applying chalk to the cue tip. The talc dispenser has a storage compartment with a rotatable cover.

Gossman, U.S. Pat. No. 5,104,122, describes a tool having a multiplicity of elements for treating a cue stick tip. The device includes one or more abrasive portions that can be used to shape or scuff the leather cue tip surface, a tooth member for perforating the leather tip to engage it to retain chalk, a rounded elongated groove or channel having one portion of the abrasive material with the remainder of the channel smooth for sculpting or scuffing the sides of the pool tip, and a burnishing member that can be rotated around the sides of a leather pool cue tip to burnish the sides.

None of the patents describe a device that incorporates all of the features mentioned in each of the patents, nor is there any mention of a device having the capability of tallying a score.

The inventor has thus recognized a need for a pocketable, billiard accessory that provides the basic tip conditioning functions of scraping, shaping and chalking the tip of a cue stick, having the capability to hold and dispense talc for easier sliding of the cue, and capable of tracking the scores of the players.

SUMMARY OF THE INVENTION

It is an object of the invention to provide a billiard accessory for use during a billiard or similar type of game requiring the use of a cue stick, that is self contained, pocket sized, and can be used to tally one or more scores in the game.

It is another object of the invention to provide the device described above which can also be used for scraping a tip attached to a pool cue stick.

It is a further object of the invention to provide a device as described that can be used to shape the tip of a pool cue stick.

It is a still further object of the invention to provide a device as described that can be used to chalk the tip of a pool cue stick.

It is still another object of the invention to provide a device as described that has a refillable talc dispenser.

It is a further object of the invention to provide a device having all of the features described above and which has an attractive and well built appearance; which unobtrusively can sit on the rail of a billiard or pool table; and be carried in an ordinary pocket in the clothes of the user without the possibility of dispensing talc or chalk when not in use.

A billiard accessory comprises a first housing and second housing which, in a preferred embodiment, are generally cylindrical in shape and which can be engaged or disengaged by means of mating male and female threads located at one end of each of the housings. The first housing has a series of scoring indicia around a portion of the circumference of the housing and two rotatable scoring wheels, each of which is flushly mounted in an annular groove in the circumference of the first housing. Each of the scoring wheels is located adjacent opposite sides of the scoring indicia providing the ability to tally two scores. A first end of the first housing has a flat, annular surface while the second end is flat, annular, and recessed in an integrally connected sleeve. Each annular end surface has an inner diameter sufficient to pass the tip of a pool cue stick. The exposed end surfaces of the inner body of the first housing adjacent the ends of the housing are concavely shaped with different radii of curvature and coated with an abrasive material for scraping and shaping the tip of a pool cue stick. The centers of curvature of the concave, abrasive surfaces are substantially collinear with a longitudinal axis of the cylindrical housing which facilitates the compactness of the device.

The second housing has a first, open end including male threads for engaging a complementary set of female threads in the sleeve portion of the first housing and a second, flat end. The flat end has a hole passing therethrough which provides an opening between the interior of the second housing and the outside.

A rotatable cap is attached to the second end surface by a central, spring loaded shaft which passes through the second end surface. The second end surface is partially padded to provide a friction reducing surface between the inner surface of the cap and the exterior surface of the second end to provide smooth rotation of the cap. The cap also has a hole passing therethrough, radially located such that it can be aligned with the hole in the second end surface. In one aspect of the invention, the exterior surface of the cap further includes a press fit insert that can contain customized indicia, or could have a surface for filing a cue stick tip, for instance.

A cue chalk holder is removably disposed in the first open end of the second housing. The cue chalk holder includes a base portion and a plurality of arms depending transversely therefrom sufficiently shaped for grasping a cue chalk cube. The terminal ends of each of the arms includes an outwardly extending lip which upon first inserting the base of the cue chalk holder in the first open end of the housing provide a plurality of services which engage the perimeter of the first open end for limiting the depth of insertion of the cue chalk holder. The arms of the cue chalk holder are of a sufficient length to conveniently position the chalking surface of the cue chalk at the first open end of the second housing. When assembled, the second end surface, the housing sidewall, and the base of the cue chalk holder define a refillable chamber for holding talc which can be dispensed from the device when the hole in the cap is aligned with the holes in the second end surface.

The invention thus describes a compact, billiard accessory which allows the user to tally two billiard scores, scrape a cue stick tip, shape a cue stick tip, chalk a cue stick tip, and powder his or her hand to reduce friction on the cue stick.

The invention will now be described in more detail with reference to the drawings in which:.

BRIEF DESCRIPTION OF THE DRAWINGS

FIG. 3 is a partial cross sectional, elevational view of the first housing showing the abrasive coated shaping and scraping surfaces;

FIG. 4 is a plan view of the cap of the billiard accessory through section 4—4 of FIG. 2 showing a tapered hole in the cap for dispensing talc from the chamber in the second housing, and an insert on the cap surface;

FIG. 5 is a plan view of the second end surface of the second housing through section 5—5 of FIG. 2 showing the friction reducing pads located on the end surface, one of which is an annulus to accommodate a hole in the end surface which provides an exit for talc in the chamber of the second housing;

FIG. 8 is a enlargement of the side wall of the second housing of FIG. 2 showing the taper between the inner housing surface and the exterior surface of the housing.

DETAILED DESCRIPTION OF THE INVENTION

Figure 6:
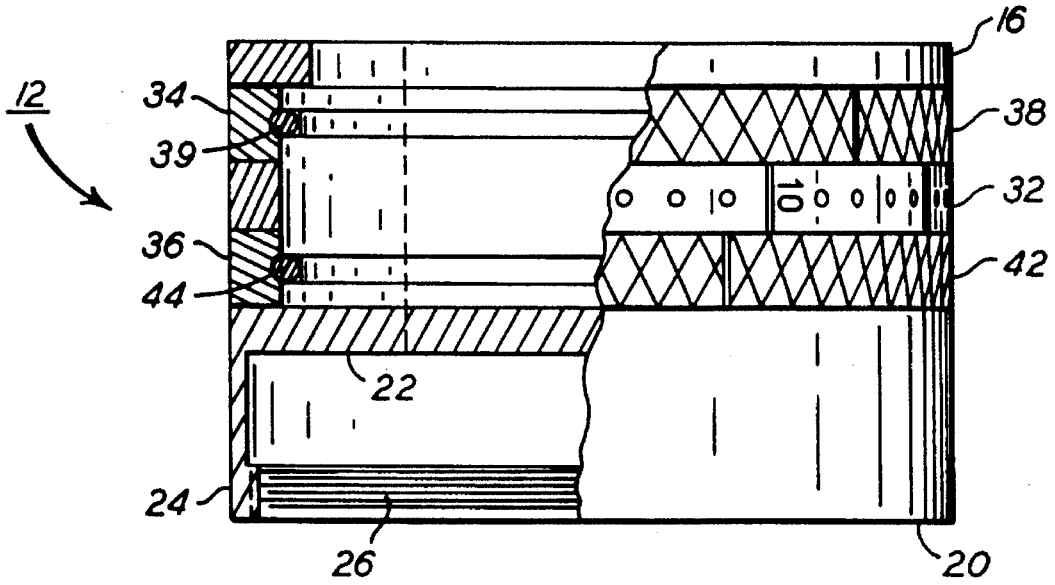
FIG. 6 is a partial cut away, side elevational view of the first housing showing the annular grooves in the perimeter of the housing and the o-ring placement for the rotatable scoring wheels.
Figure 7:
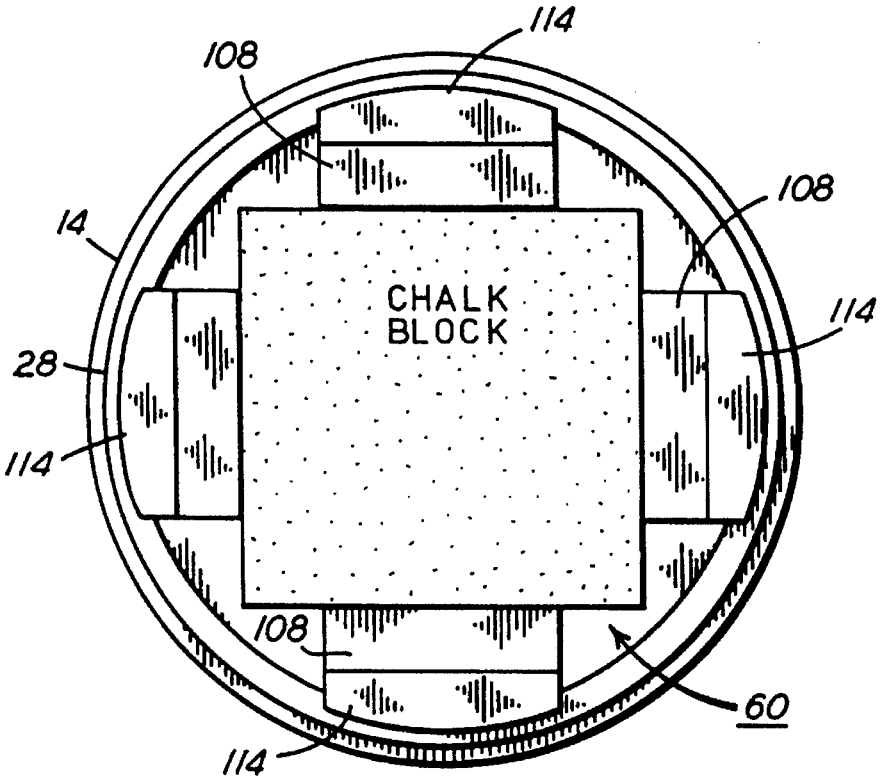
FIG. 7 is a plan view of the cue chalk holder and a cue chalk through section 7—7 of FIG. 2 showing the lips on the end of the chalk holder arms engaging the surface of the top, open end of the second housing.

Referring now to the drawings, a billiard accessory 10 comprises a first housing 12 and a second housing 14 removably connectable thereto. In a preferred aspect of the invention, the housings are constructed of aluminum; and, both separately and in combination, are generally cylindrical in shape. The housing material and housing shape, however, are not limiting features of the invention; for example, other metals such as stainless steel or pewter, or materials such as wood, plastic, glass or combinations thereof, would be suitable; and polygonal or rectangular exterior housing shapes, for example, are contemplated. As shown in FIGS. 3 and 6, the first housing 12 includes a first end 16 having a flat, annular surface 18, and a second end 20 having a recessed, flat, annular surface 22 including a sleeve 24 integrally depending therefrom for receiving the second housing 14. In a preferred aspect of the invention, a series of female threads 26 is located around a portion of the inner perimeter of the sleeve 24 for engaging a mating series of male threads 28 located on a first end 60 of the second housing 14 to allow the two housings 12, 14 to be joined or disconnected by screwing or unscrewing them, respectively. The invention is not limited to a screw type engagement between the first and second housings, and a press fit, bayonette or snap fit, or other connection, for example, would also be suitable.

A series of scoring indicia 32 is fixedly arranged around the perimeter of the first housing 12. Preferably, the scoring indicia consists of color-highlighted depressions in the form of lines, dots and numbers in the housing. The indicia could alternatively be raised, engraved, inked, decaled or otherwise applied. A first annular groove 34 having a generally rectangular or round cross section is located in the first housing 12 intermediate the first end 16 and the scoring indicia 32, and a second annular groove 36 of similar or different cross section is located in the housing 12 intermediate the scoring indicia 32 and the second end 20, as shown in FIG. 6. Auxiliary grooves 33, 35, having generally rectangular or rounded cross sections, are located, respectively, in annular grooves 34, 36 for receiving a resilient member 39, preferably an o-ring made of plastic or natural or synthetic rubber or the like. A first scoring wheel 38, preferably having a knurled, or otherwise roughened circumferential surface to aid in grasping and rotating the wheel, is disposed in the first groove 34 flush with the exterior of the housing so as to encircle the first o-ring groove 33. The resilient member 39 allows the wheel to be rotated with a comfortable feeling of resistance; and preferably, a small amount of grease or other suitable lubricant applied to the exterior o-ring surface accomplishes this best. The knurled surface of the wheel further includes an indicia 41, similar in application and appearance to the scoring indicia, to allow positioning of the wheel 38 with respect to the scoring indicia 32 for tallying a score value. A second scoring wheel 42, identical in design and appearance to the first scoring wheel 38, is similarly located in the second annular groove 36 in the housing, rotatably secured by resilient member 39 occupying annular groove 44, allowing for a second score to be tallied. The scoring wheels are preferably constructed of plastic or metal and have a slide fit in their respective grooves. The material of the scoring wheels could also be the same as the housing material, or a complimentary material.

Referring now to FIG. 3, the inner body 70 of the first housing 12 includes concave surface 72 adjacent the first end 16 and concave surface 74 adjacent the second end 22. The surfaces 72, 74 have non similar radii of curvature and are coated with an abrasive material. Surface 72 is more concave than surface 74 and the abrasive coating is coarser than that of surface 74. The curvature and roughness of surface 72 is used for scraping or scuffing a cue stick tip; while the curvature and roughness of surface 74 is selected for shaping a cue stick tip. The abrasive coating preferably comprises crushed glass; however, other commonly recognized abrading materials could be used. The respective centers of curvature of surfaces 72, 74 are collinear with the longitudinal axis of the housing (not shown). Furthermore, the invention is not limited by the relative position of surfaces 72 and 74 and, as such, the scraper and the shaper surface locations could be interchanged without departing from the scope of the invention.

Figure 1:
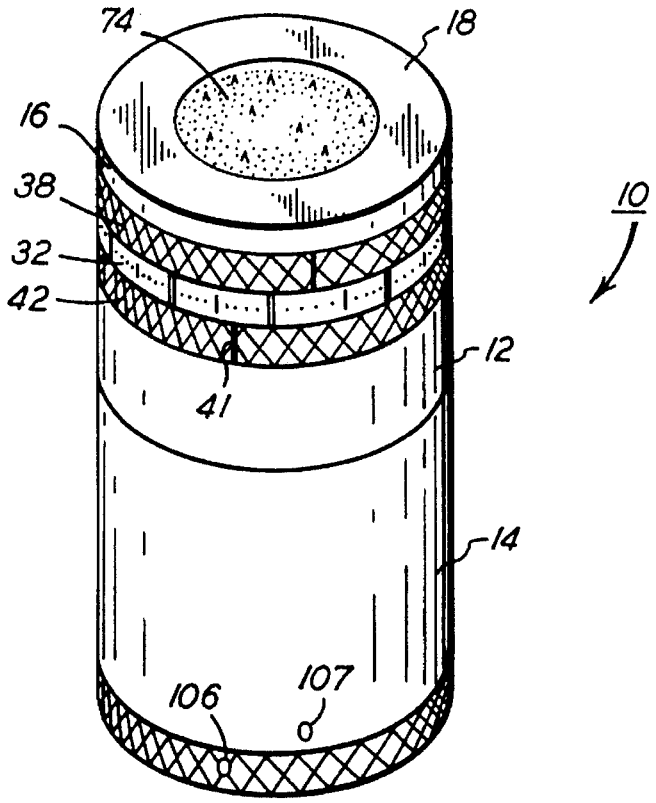
FIG. 1 is a perspective view of the billiard device.
Figure 2:
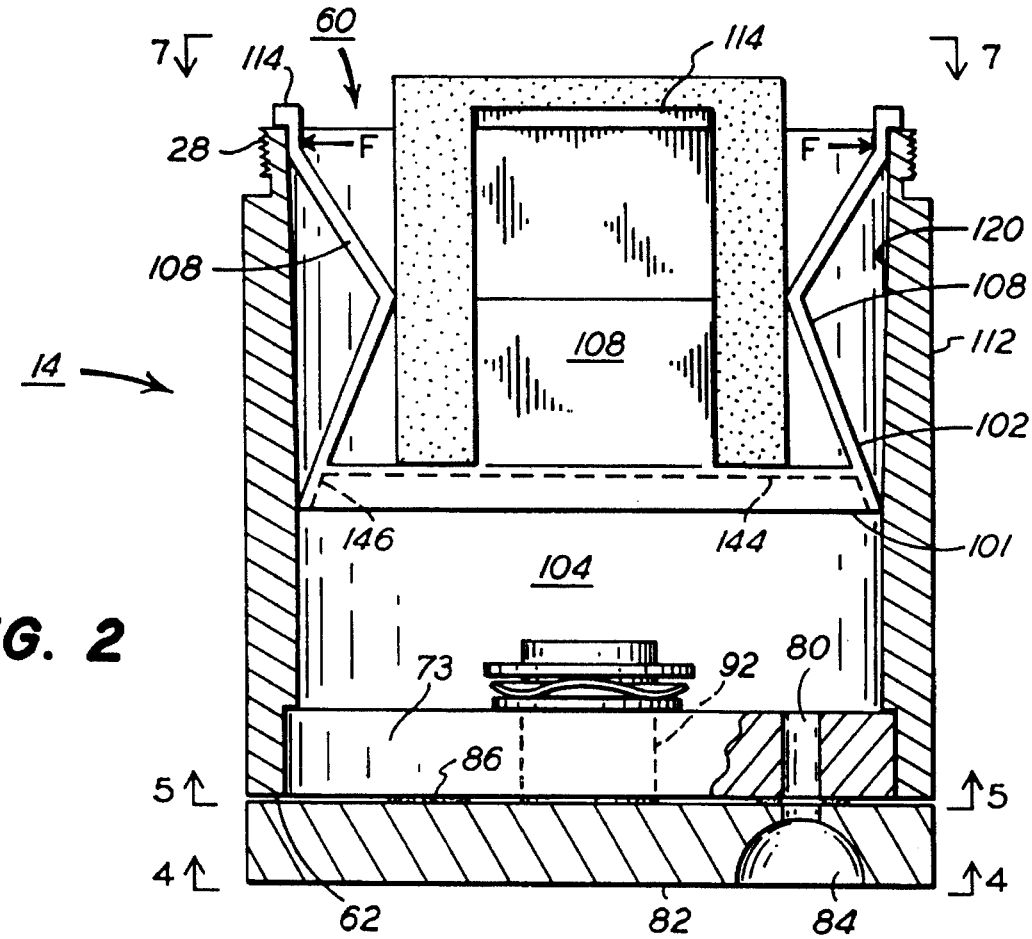
FIG. 2 is a cross sectional, elevational view of the second housing of the billiard accessory.

Referring now to FIGS. 2, 4 and 5, the second housing 14 includes a first, open end 60, a press fit disc 73 comprising a second end 62 of the housing including a flat surface having a hole 80 passing therethrough, and a cap 82 having a hole 84 through a portion thereof, the cap being rotatably mounted on the second end 62 by a central shaft 92 passing through the second end surface 62, and attached thereto by a pressure washer and spring type clip. The second end of the housing, in combination with the housing walls, and the base portion 101 of a cue chalk holder 102, which will be described in greater detail below, define a refillable chamber 104 in the second pan of the housing for holding talc which a player can apply to his or her hand to decrease the friction of the cue stick. The hole 84 in the cap 82 is radially located so as to align with the hole 80 in the second end disc surface 62 of the housing when the cap is rotated to a designated position, marked by matching indicia 106, 107, on the side of the housing and the knurled perimeter of the cap, respectively, similar in application to the scoring indicia, as shown in FIG. 1. When the hole 84 in the cap is not aligned with the hole 80 in the second end 62 of the housing, the solid cap surface prevents talc from being dispensed from the chamber 104. In an aspect of the preferred embodiment, the cap 82 includes an insert 110 of a material such as brass, pewter, silver or gold, for example, which can be engraved or otherwise marked to customize the accessory, or having an abrasive surface for filing a cue stick tip.

In a preferred aspect of the invention, the second end surface 62 is made of a molded plastic material and includes three pads 86 integrally projecting from the surface and in slidable contact with the inner surface of the rotatable cap. One of the pads is located over hole 80 and is in the form of an annulus so as not to obstruct the hole. The pads provide a smooth contact surface between the cap and the end surface of the housing to counteract the friction therebetween due to the spring washer and clip used to hold the cap and to assist in the rotation and stationary positioning of the cap. Alternatively, the pads could be made of any suitable cloth such as felt, or inorganic material like teflon, and be fixedly attached to a uniformly smooth surface of 62 for performing the same function.

A chalk holder is received in the first, open end 60 of the second housing 14. The chalk holder 102 comprises a base 101 in the form of a solid disk portion 144 having a diameter less than the inner diameter of the housing and a deformable, outwardly tapering flange portion 146 having a maximum diameter slightly greater than the inner diameter of the housing for providing a removable, sealing surface within the housing, and one or more opposed arms 108 depending transversely therefrom, each arm 108 having a shape sufficient to grasp a standard cue chalk. The shape of the arms 108 are also sufficient to exert a frictional, biasing force F against the inner wall 120 of the housing 14 at the first, open end 60. Each arm includes a lip 114 at a terminal end thereof which engages the top surface of the open end of the housing and limits the depth of insertion of the chalk holder into the second housing. Furthermore, the interior wall 120 of the second housing tapers slightly outward towards the first, open end 60 to insure substantially sealing contact between the base flange portion 146 and the housing wall, thus forming the refillable talc chamber 104 described above, and as defined by the base portion 101 of the chalk holder, the interior wall of the housing and the interior surface of the second end of the housing. In a preferred aspect of the invention, the chalk holder is constructed from plastic. The material of the chalk holder is not a limiting feature of the invention.

The scoring wheels 38, 42; the scraper surface 72, the shaper surface 74, chalk holder 102, and talc chamber 104 are all substantially coaxially aligned in the respective housings 12, 14 in order that the exterior surface of the housing is substantially flush; and the arrangement of the above described elements in the housing permit the billiard accessory described herein to sit unobtrusively along the side rail of a pool or billiard table when in use, and conveniently in a carrying pocket of the user at other times.

There has thus been described a five function billiard accessory. Those skilled in the art will recognize that modifications may be made in the device without departing from the true spirit and scope of the invention which are limited solely by the appended claims.

What is claimed is:

1. A billiard accessory, comprising:

a first, generally cylindrical housing and a second, generally cylindrical housing coaxially aligned with and releasably connected to the first housing;

a first concave, abrasive surface adjacent a first end surface of the first housing, and a second concave, abrasive surface adjacent a second end surface of the first housing, in which the centers of curvature of the first and second concave surfaces are collinear and coaxial with the housings;

a cue chalk holder disposed in a first end of the second housing;

a talc chamber located within the second housing; and means for dispensing talc from the talc chamber located at a second end of the second housing.

2. The billiard accessory of claim 1, further comprising:

a series of scoring indicia arranged on a surface of the first housing;

a first rotatable scoring wheel having a designating mark, said wheel mounted on the first housing so that said scoring mark is movably disposed with respect to said series of scoring indicia for tallying a billiard score.

3. The billiard accessory of claim 2, further comprising a second rotatable scoring wheel having a designating mark, the second wheel being mounted on the first housing so that said scoring mark is movably disposed with respect to said series of scoring indicia for tallying a second billiard score.

4. The billiard accessory of claim 3 in which the series of scoring indicia is arranged between the first and second rotatable scoring wheels.

5. The billiard accessory of claim 3 in which the series of scoring indicia is arranged in a circle on the surface of said first housing.

6. The billiard accessory of claim 5 in which the circular arrangement of the scoring indicia is in the form of an annulus around a periphery of the housing.

7. The billiard accessory of claim 3 in which the first housing includes a first annular groove and the first rotatable scoring wheel is disposed in said first annular groove.

8. The billiard accessory of claim 7 in which the first housing includes a second annular groove and the second rotatable scoring wheel is disposed in said second annular groove.

9. The billiard accessory of claim 8 in which the first and second rotatable scoring wheels comprise surfaces generally flush with the housing.

10. The billiard accessory of claim 8 comprising a resilient member disposed in each of said first and second annular grooves between said housing and the first and second rotatable scoring wheels, respectively.

11. The billiard accessory of claim 10 in which the resilient member comprises an O-ring.

12. The billiard accessory of claim 10 comprising an auxilliary groove in each of said first and second grooves for retaining the resilient member.

13. A billiard accessory, comprising:

a first cylindrical housing having a first end and a second end including a sleeve integrally depending therefrom;

a series of scoring indicia arranged around a perimeter of the first housing;

a rotatable, annular scoring wheel mounted in the perimeter of the first housing between the first end and the scoring indicia; and a second cylindrical housing removably engageable with the first housing.

14. The billiard accessory of claim 13 further comprising a second, annular rotatable scoring wheel mounted in the perimeter of the first housing between the scoring indicia and the second end.

15. The billiard accessory of claim 13 in which the first end has an annular, flat surface and the second end has an annular, flat surface, and further comprising a first concave, abrasive surface located adjacent the first end and a second concave, abrasive surface located adjacent the second surface.

16. The billiard accessory of claim 13 in which the second housing has a first, open end;

a second end including a flat end surface having a hole therein; and a cap having a hole therein, rotatably mounted on the second end, whereby the hole in the cap is selectively alignable with the hole in the second end surface to define a channel between the inside and outside of the housing.

17. The billiard accessory of claim 16 further comprising a cue chalk holder disposed in the second housing, including a base having a disc portion and an outwardly tapering flange depending from a perimetal portion of the disc, and a plurality of arms depending from the base for grasping the cue chalk.

18. A billiard accessory, comprising:

a housing including means for tallying a score in a game;

means for conditioning a tip mounted on an end of a cue stick;

and means for selectively dispensing a supply of talc from within said housing; said means for conditioning said tip include a concave, abrasive surface for scraping said tip, and a different concave, abrasive surface for shaping said tip, in which both surfaces have collinear centers of curvature.

19. The billiard accessory of claim 18 in which the means for conditioning the tip includes a cue chalk holder.

* * * * *